United States Patent [19]

Harris

[11] 4,422,264

[45] Dec. 27, 1983

[54] SAFETY GATE ASSEMBLY

[75] Inventor: William S. Harris, Moravia, N.Y.

[73] Assignee: Roly-Door Sales Company of Rochester, Inc., Rochester, N.Y.

[21] Appl. No.: 428,170

[22] Filed: Sep. 29, 1982

[51] Int. Cl.[3] ..... E05F 17/00

[52] U.S. Cl. ..... 49/121; 49/445

[58] Field of Search ..... 49/93, 99, 119, 123, 49/121, 445, 73; 160/113, 114

[56] References Cited

U.S. PATENT DOCUMENTS

| | | | |
|---|---|---|---|
| 1,611,013 | 12/1926 | Francke | 160/114 |
| 3,600,854 | 8/1971 | Dallaire et al. | 49/121 |
| 3,945,149 | 3/1976 | Boucher | 49/121 |

*Primary Examiner*—Philip C. Kannan

*Attorney, Agent, or Firm*—Cumpston & Shaw

[57] ABSTRACT

A safety gate assembly includes a pair of gates guarding a pre-selected area, the gates being coupled together with cables and pulleys so that one of the gates is always closed to prevent someone from accidentally walking through the area and being injured. The gates are balanced to make movement thereof easy and self-biased to stably open and closed positions.

8 Claims, 3 Drawing Figures

SAFETY GATE ASSEMBLY

This invention relates in general to means for controlling access to a pre-selected area and more particularly to a safety gate assembly for preventing simultaneous access to a pre-selected area through two coupled gates.

It is often desirable to provide controlled access to a pre-selected area, for example, to prevent injury or the escape of dangerous materials or the like. An example of such an area would be an elevated loading platform or mezzanine accessible from one side by a fork lift to similar truck and from another side by material handlers using wheeled carts or dollies. Frequently, one side of such an area is raised above a floor so as to provide a mezzanine storage area or balcony thereby advantageously improving the utilization of expensive floor space and increasing the amount of material that can be stored in a given amount of floor space. The invention is also useful in connection with a loading dock that provides level access to the bed of a truck which is normally a substantial height above the ground sufficient to cause injury if fallen from.

Heretofore, it has been common practice to employ a pair of safety chains suspended between supporting pillars or posts on opposite sides of entrances to such areas, and controlling the access to such an area by requiring that one of said two such chains guarding two accesses to the area is always in place. This procedure relies upon the diligence of the operators, which diligence may lapse during the press of tight schedules or the like. The chance of injury is greatly increased when neither chain is in place and an unwary operator may inadvertently walk directly through the controlled area and fall from the elevated edge thereof.

It is the object of this invention to provide an improved safety gate assembly for controlling access to a pre-selected area that does not rely upon diligent adherence to safety rules, but instead automatically insures that only one of two gates controlling access to such an area can be open at any time.

It is another object of this invention to provide such an assembly in easy-to-manufacture and inexpensive form which is reliable and sturdy.

Briefly stated and in accordance with a presently preferred embodiment of the invention, a safety gate assembly for controlling access to a pre-selected area includes first and second vertically movable gates guarding access to the pre-selected area, the gates being coupled together so that upon raising one gate to an opened position, the other gate is automatically lowered to the closed position thus insuring that access directly through the pre-selected area will never be available and avoiding the possibility of an accident.

In accordance with a particular aspect of this invention, the first and second gates are disposed for vertical movement in inverted generally U-shaped parallel tracks and coupled together by an arrangement of cables and pulleys.

In accordance with another aspect of this invention, first and second vertically movable gates are arranged so that each acts as a counter-weight for the other to assist in raising and lowering the gates, notwithstanding the substantial mass thereof.

In accordance with another aspect of this invention, the gates are arranged so that when one gate is in its raised position, the weight thereof is at least partially supported by the tracks thereby stably biasing the other gate into the closed position.

The features of the invention which are believed to be novel are set forth with particularity in the appended claims.

The foregoing and further objects and advantages of the invention will become more readily apparent by reference to the following detailed description thereof taken in conjunction with the accompanying drawing in which:

FIGS. 2 and 3 show, inter alia, supporting structures for and details of the gate assembly of this invention not shown in FIG. 1.

Figure 1:
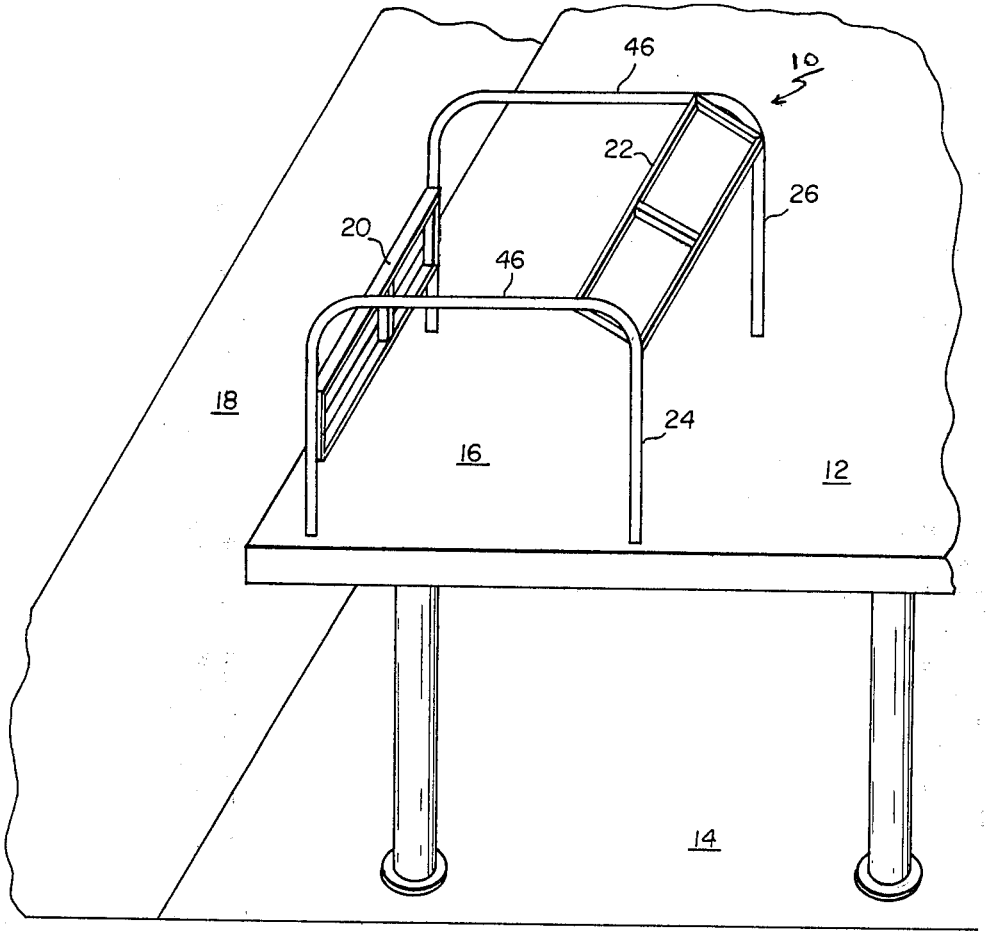
FIG. 1 is a perspective view of a safety gate assembly according to this invention in simplified schematic form showing the environment in which the invention may be usefully employed.

Referring now to FIG. 1, a schematic view of a safety gate assembly in accordance with this invention is shown. Assembly 10 is disposed on an elevated platform or mezzanine 12 raised above a factory or warehouse floor 14. Safety gate assembly 10 guards a pre-selected area 16 of the elevated platform to provide controlled access thereto from mezzanine 12 as well as from aisle 18. Walls or the like (not shown) prevent access from the sides of assembly 10.

Such an assembly can be used, for example, where a quantity of material is loaded into pre-selected area 16 from the factory floor by a fork lift truck or similar instrument and removed from the opposite side to mezzanine 12 by material handlers as the material is required. Through the use of this invention, when a safety gate 20 on the aisle side is open, a safety gate 22 on the mezzanine side is automatically closed and vice versa to prevent a material handler from inadvertently walking through the controlled area and falling to the factory floor and perhaps sustaining grave injury. Omitted from FIG. 1 for purposes of clarity are supporting structures for gate assembly 10. Walls or beams may advantageously be employed as supports for assembly 10 and may also serve to restrict access to area 16 through the sides of assembly 10. Alternatively, a number of assemblies, such as the one shown, may be arranged side by side to provide separate independently controllable areas. Where a plurality of assemblies is used, it is preferred to permanently restrict access from one to another by a side wall or other blocking structure.

Figure 3:
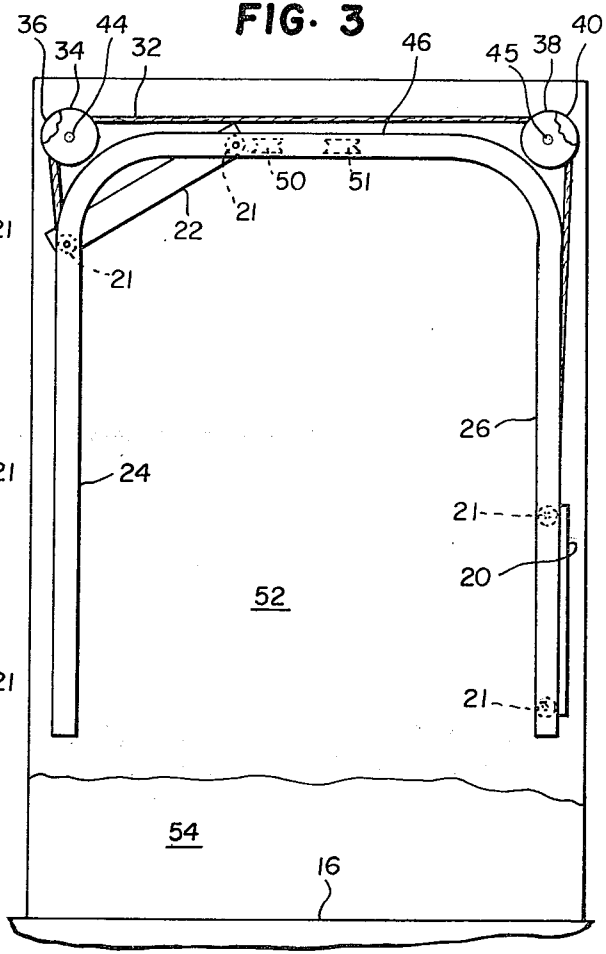
FIG. 3 is a right side elevational view of the safety gate assembly of FIG. 2.
Figure 2:
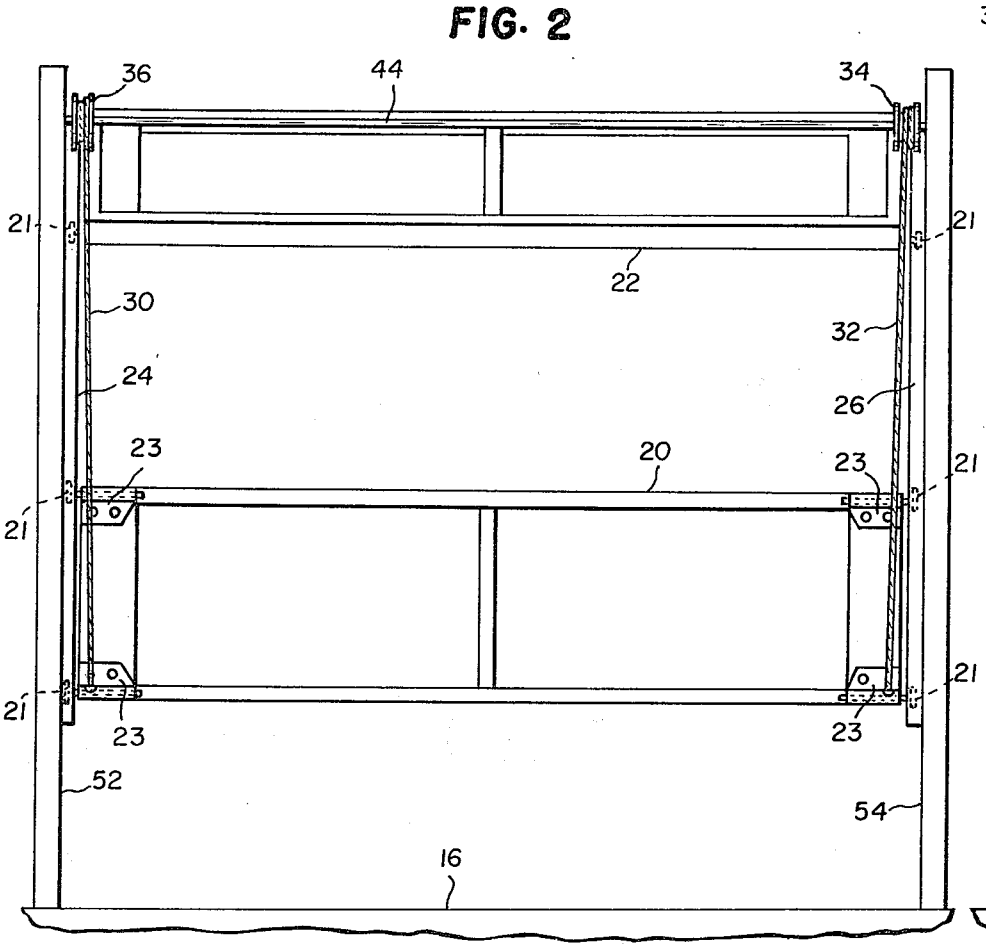
FIG. 2 is a rear elevational view of a safety gate assembly according to this invention showing the front gate closed and the rear gate open.

FIGS. 2 and 3 are a rear view and a side view respectively, of a safety gate assembly in accordance with this invention. The assembly includes two gates, 20 and 22 preferably constructed of welded steel tubing or similar material, each including a plurality of rollers 21 each mounted at the end of a stem and attached to the gate with a suitable attaching bracket 23 at each corner of the gate. The rollers engage a pair of inverted U-shaped tracks 24 and 26. Tracks 24 and 26 are, as shown, generally inverted U-shape, are parallel to each other, and have an essentially constant C-shaped cross section for engaging and guiding rollers 21. Such rollers and tracks are similar to those commonly employed on overhead garage doors and are readily available. Tracks 24 and 26 are preferably fastened to, and supported by, support members 52 and 54 which may be walls or beams or the like. Support members 52 and 54 also support pulleys 34, 36, 38 and 40 are more fully described hereinbelow.

Tracks 24 and 26 may be assembled from available straight and curved sections having lengths suitable to surround pre-selected area 16. Gates 20 and 22 are coupled together by cables 30 and 32 which are guided between the gates by pulleys 34 and 36 positioned above gate 22 and pulleys 38 and 40 positioned above gate 20. Preferably cables 30 and 32 are attached to gates 20 and 22 near the bottoms of the gates as will be hereinafter more completely explained.

In accordance with a preferred embodiment of this invention, pulleys 34 and 36 are connected together by shaft 44, and cables 30 and 32 are wrapped around pulleys 36 and 34 respectively several times. This insures that as gate 20 is lifted pulleys 34 and 36 will turn together and cables 30 and 32 will not slip on the pulleys so that gate 20 will not become skewed in tracks 24 and 26 and bind, even if a lifting force is applied solely to one or the other sides or corners of the gate.

A further aspect of the invention may be seen by particular reference to FIG. 3 wherein gate 20 is shown in the closed position while gate 22 is shown in the opened position. While both gates are disposed in the vertical sections of tracks 24 and 26, the substantially equal weights of the gates balance each other and the gates may be easily moved by the application of only a slight force thereto. When one of the gates is moved further to the open position as shown in FIG. 3, a substantial portion of the weight of the gate is supported by horizontal track section 46, and the other gate 20 is biased into a stable, closed position by its own weight.

The extent to which pulley 21 of gate 22 may ride along horizontal track portion 46 is limited by positioning a stop 50 on the horizontal portion of one or both of tracks 24 and 26. Stop 50 is preferably a block of resilient material such as rubber or plastic disposed within the C-shaped section of track 24 and/or 26. Where the horizontal portions of tracks 24 and 26 are short, the opposite ends of a single stop may serve both of gates 20 and 22. Where, however, the horizontal portion is long, a second laterally spaced stop 51 positioned in either or both of tracks 24 and 26 may be required for each gate. Because pulleys 34, 36, 38 and 40 in combination with cables 30 and 32 prevent uneven motion of gates 20 and 22, the stop or set of stops in one of tracks 24 or 26 may be dispensed with if desired.

While this invention is particularly useful as a safety gate assembly, the inventive concept is not so limited. For example, the invention may be employed in an area for the storage of refuse or trash by substituting solid doors for gates 20 and 22 and lengthening cables 30 and 32 to allow the doors to reach the floor or ground level. Refuse may then be placed into the area defined by the assemblies through one door and removed from the other door without the problem of inadvertant spillage when loading.

While the invention has been described in connection with a certain presently preferred embodiment thereof, those skilled in the art will appreciate that certain modifications and changes therein may be made without deviating from the true spirit and scope of the invention which is intended to be limited solely by the appended claims.

I claim:

1. An assembly for controlling access to a pre-selected area comprising:

first and second generally U-shaped tracks disposed on first and second sides of said pre-selected area;

a first movable gate including means for engaging said tracks and for guiding said gate in said tracks between a raised and lowered position, said gate disposed generally on a third side of said pre-selected area;

a second movable gate including means engaging said tracks and movable between a raised and lowered position and disposed generally on a fourth side of said pre-selected area; and means coupling said first and second gates for lowering said first gate when said second gate is raised and vice versa for preventing said first and second gates from being raised simultaneously, thereby controlling access to said pre-selected area.

2. The assembly of claim 1 wherein said means coupling said first and second gates comprises pulleys, and cables riding in said pulleys and connected to said first and second gates.

3. The assembly of claim 2 wherein said cables engage said pulleys for preventing slipping of said cables with respect to said pulleys.

4. The assembly of claim 3 further comprising means coupling said pulleys for preventing skewing of said gates in said tracks.

5. The assembly of claim 1 further comprising means coupling said gates whereby the movement of said first gate from the lowered to the raised position is assisted by the weight of the second gate moving from the raised to the lowered position and vice versa.

6. The assembly of claim 3 wherein said raised position of said first or second gates comprises a position wherein said gate is disposed at least partially displaced from a vertical orientation whereby the effective weight of said gate is reduced and the other gate remains stably in said lowered position.

7. The assembly of claim 1 wherein said first and second tracks comprise tracks of uniform generally C-shaped cross section, said tracks disposed in an inverted position and parallel to each other.

8. The assembly of claim 5 wherein said first and second gates comprise generally rectangular gates each having one or more guiding rollers disposed at the sides thereof for engaging said tracks and guiding said gates in vertical movement.

* * * * *